United States Patent [19]

Zeilinger

[11] 4,450,799

[45] May 29, 1984

[54] VALVE CLEARANCE COMPENSATOR FOR INTERNAL COMBUSTION ENGINES

[75] Inventor: Karl Zeilinger, Berglen, Fed. Rep. of Germany

[73] Assignee: Daimler-Benz Aktiengesellschaft, Fed. Rep. of Germany

[21] Appl. No.: 177,073

[22] Filed: Aug. 11, 1980

[30] Foreign Application Priority Data

Aug. 10, 1979 [DE] Fed. Rep. of Germany ..... 2932504

[51] Int. Cl.[3] ..... F01L 1/22

[52] U.S. Cl. ..... 123/90.53; 123/90.45

[58] Field of Search ..... 123/90.16, 90.48, 90.52, 123/90.53, 90.55, 90.39, 90.45

[56] References Cited

U.S. PATENT DOCUMENTS

| | | | |
|---|---|---|---|
| 1,571,175 | 1/1926 | Bazzoni | 123/90.53 |
| 1,609,711 | 12/1926 | Goodwin | 123/90.53 |
| 1,733,240 | 10/1929 | Salves | 123/90.53 |
| 1,986,579 | 1/1935 | Johnson | 123/90.55 |
| 3,538,895 | 11/1970 | Jensen | 74/569 |
| 3,599,613 | 8/1971 | Freese | 123/90.52 |

FOREIGN PATENT DOCUMENTS

| | | | |
|---|---|---|---|
| 1451942 | 4/1970 | Fed. Rep. of Germany | 123/90.52 |
| 2062158 | 5/1981 | United Kingdom | 123/90.53 |

*Primary Examiner*—Craig R. Feinberg
*Assistant Examiner*—W. R. Wolfe
*Attorney, Agent, or Firm*—Craig & Burns

[57] ABSTRACT

A valve clearance compensator for an internal combustion engine. The compensator includes a sliding member provided with a wedge-shaped surface. The sliding members are arranged so as to be axially displaceable between each control cam of a camshaft and an associated valve. The sliding member is acted upon in one direction constantly by a compression spring but acted upon in the other direction intermittently by an adjusting member. The adjusting member is connected with the camshaft and is adapted to displace the sliding member against the force of the compression spring when the associated valve is in a closed position and over a partial range of a closed period of the valve.

12 Claims, 5 Drawing Figures

VALVE CLEARANCE COMPENSATOR FOR INTERNAL COMBUSTION ENGINES

The present invention relates to a compensating arrangement and, more particularly, to a valve clearance compensator for internal combustion engines, with the compensator including a sliding member provided with a wedge-shaped surface and being arranged to be axially displaceable between each control cam of a camshaft and an associated valve, which sliding member is acted upon in one direction constantly by a compression spring and, in the other direction, intermittently acted on by way of an adjusting member.

A valve clearance compensator of the aforementioned type is proposed in U.S. Pat. No. 3,087,479, wherein a wedge-shaped sliding member is inserted between a push rod part of a valve drive mechanism. The sliding member is adapted to be shifted, on the one hand, by a compression spring and, the other hand, by a roller traveling along an inclined ramp and connected to the sliding member so that the sliding member moves between the push rod sections.

The displacement of the sliding member in a direction toward a "clearance" generally takes place at a point in time when the valve operating parts are under load, that is, during an opening stroke of the valve. In this manner, a shortening of the valve stroke occurs by a shifting on a side of the push rods. As soon as the valve has returned to a closed position, the clearance existing between the cam and the valve in the valve operating parts is compensated for by the sliding member which is under the constant effect of the compression spring. Thus, with the proposed valve clearance compensator, the valve stroke is dependent upon a displacement path of the wedge-shaped sliding member.

The aim underlying the present invention essentially resides in constructing a mechanical valve clearance compensator which compensates for wear and variations in a length of the valve operating parts so that a clearance compensation between the cam and valve may be obtained with the valve stroke remaining the same at all times.

In accordance with the advantageous features of the present invention, the adjusting member is connected with the camshaft and displaces the sliding member in the closed position of the valve over a partial range of a closing period against the compression spring.

In accordance with further advantageous features of the present invention, the adjusting member is formed of a disk fixedly connected to the camshaft with a cam which displaces the sliding member axially. Advantageously, the sliding member is displaceably guided in a tilting lever or rocker arm and the compression spring, which constantly acts on the sliding member, is accommodated in a laterally projecting housing integrally joined with the tilting lever or rocker arm.

Advantageously, the sliding member in the compensator of the present invention is latitudinally movably guided in a cup tappet, with an axially displacing piston receiving the compression spring and cooperating with the sliding member, which piston is arranged in a recess of the cylinder head.

In accordance with still further features of the present invention, the compression spring is guided within the cup tappet and the adjusting member is constructed so as to be a rotatably supported tilting lever with one lever arm thereof being supported on the control cam of the camshaft and the other lever arm thereof contacting the spring loaded sliding member.

Accordingly, it is an object of the present invention to provide a valve clearance compensator for internal combustion engines which avoids, by simple means, shortcomings and disadvantages encountered in the prior art.

Another object of the present invention resides in providing a valve clearance compensator for internal combustion engines which automatically compensates for wear and variations in the length of the valve operating parts in addition to maintaining the valve stroke the same at all times.

Yet another object of the present invention resides in providing a valve clearance compensator for internal combustion engines which is simple in construction and therefore relatively inexpensive to manufacture.

A further object of the present invention resides in providing a valve clearance compensator for internal combustion engines which functions reliably under all operating conditions of the engine.

These and other objects, features, and advantages of the present invention will become more apparent from the following description when taken in connection with the accompanying drawings which show, for the purposes of illustration only several embodiments in accordance with the present invention, and wherein.

Figure 1:
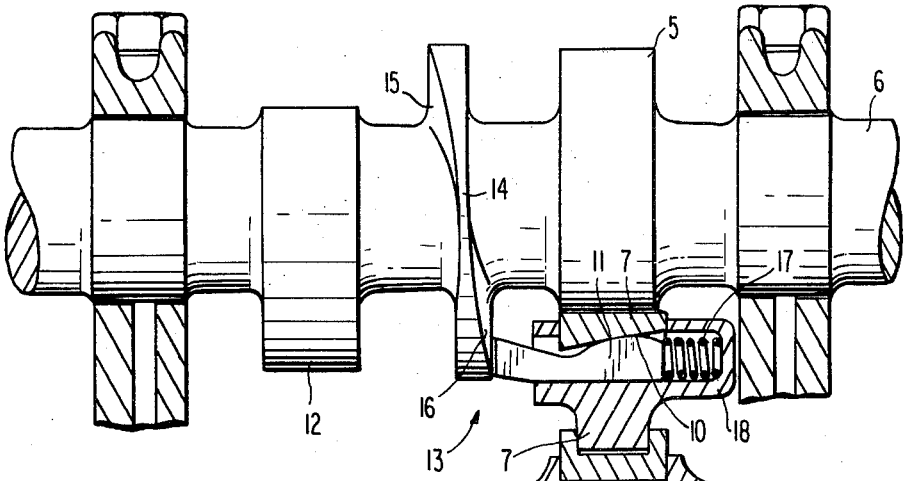
FIG. 1 is a cross sectional view of control elements of a valve operating mechanism of an internal combustion engine, with a valve clearance compensator in accordance with the present invention being accommodated in a drag lever.
Figure 2:
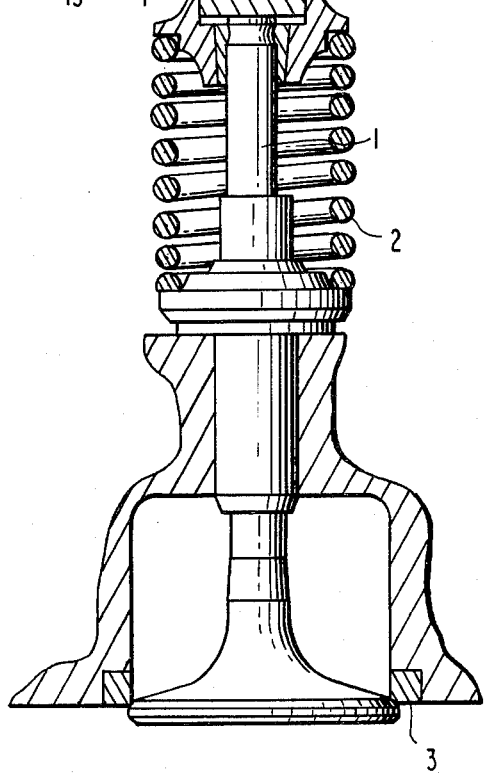
FIG. 2 is a partial cross sectional side view of the valve clearance compensator of FIG. 1.
Figure 2:
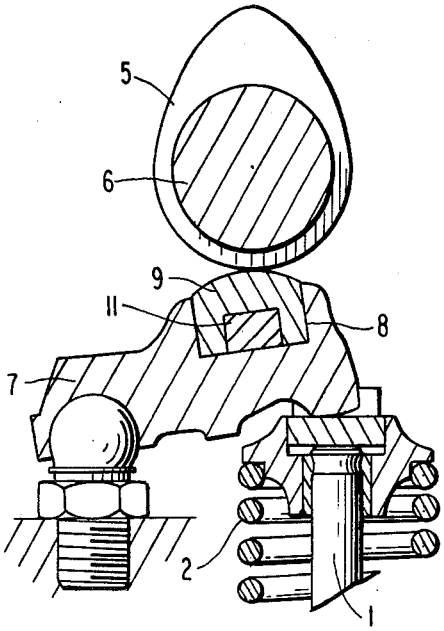

Referring now to the drawings wherein like reference numerals are used throughout the various views to designate like parts and, more particularly, to FIG. 1, according to this figure, an internal combustion engine includes a valve 1 which is urged, in a conventional manner, onto a valve seat 3 disposed in a cylinder head 4 by way of a valve spring 2. The valve 1 is operated by a control cam 5 of camshaft 6 disposed above the valve 1 by way of a pivotably mounted rocker arm or drag lever 7. A vertically displaceable tightening or adaptor element 9 is guided in a groove 8 of the rocker arm 7, with a sliding member 11, provided with a wedge-shaped surface 10, being longitudinally displaceable in the tightening element at right angles to a central longitudinal axis of the valve 1.

An adjusting member generally designated by the reference numeral 13 is fixedly joined to the camshaft 6. The adjusting member 13 is disposed between the control cam 5 and another control cam 12. The adjusting member includes a disk 14 and a cam 15, 16 arranged on each side of the disk 14 and acting in an axial direction. The cam 16, in the closed position of the valve 1, as illustrated in FIG. 1, displaces the sliding member 11 against a compression spring 17 in such a manner that the previously existing clearance-free connection between the control cam 5 of the camshaft 6 and the valve 1 now exhibits a clearance. A compression spring 17 is accommodated in a housing 18 which is integrally joined with the rocker arm 7. The sliding member 10 is under the constant effect or biasing of the compression spring 17.

Figure 3:
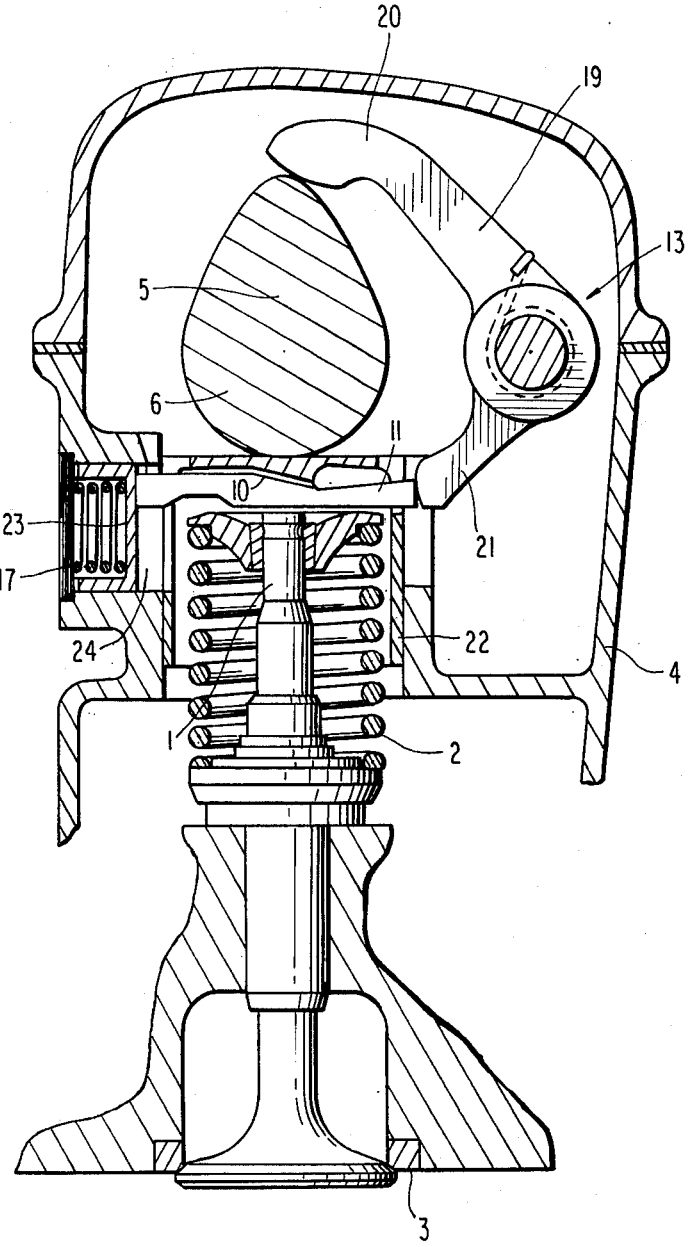
FIG. 3 is a cross sectional view of the valve clearance compensator in accordance with the present invention including a cup tappet cooperating with a valve.

In lieu of the axially acting cam 16 of FIG. 1, as shown in FIG. 3, a rotatably mounted tilting lever 19, constructed as an angle or belt crank lever, may be provided for controlling the displacement of the sliding member 11. One lever arm 20 of the tilting lever 19 rests on the control cam 5 and also operates the valve 1. The other lever arm 21 contacts the sliding member 11 guided in a cup tappet. The sliding member 11 is constantly acted upon by the compression spring 17 by way of a piston 23. The piston 23 is displaceably guided in a recess 24 in the cylinder head 4. During the operation of the valve 1, the sliding member 11 slides along the piston head of the piston 23 so that the sliding member 11 contacts the piston.

Figure 4:
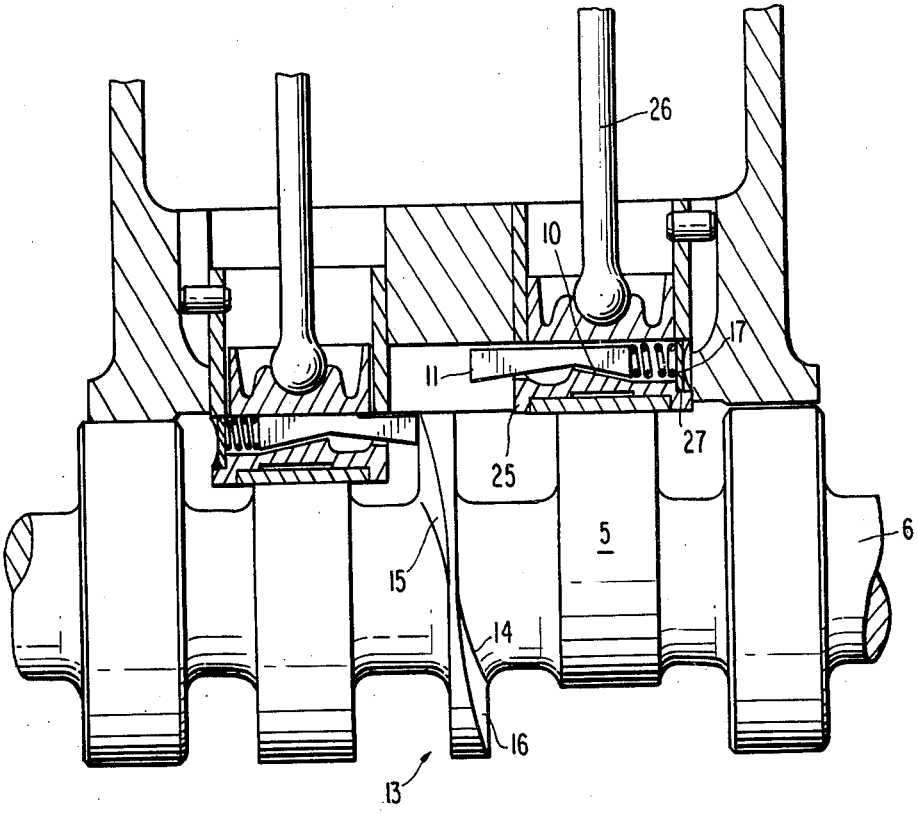
FIG. 4 is a partial cross sectional view of a valve clearance compensator in accordance with the present invention with a tappet cooperating with a push rod.

As shown in FIG. 4, the adjusting member 13, corresponding to that in the embodiment of FIG. 1, is fixedly mounted on a camshaft 6 with the camshaft 6 being arranged below the valves. A tappet 25 operated by a control cam 5, wherein a push rod 26 is guided, contains the compression spring 17 with the spring resting on the tappet part 27. The sliding member 11, provided with wedge-shaped surface 10 is latitudinally displaceable in the tappet 25 by the cams 15, 16 of the adjusting member 13.

Figure 5:
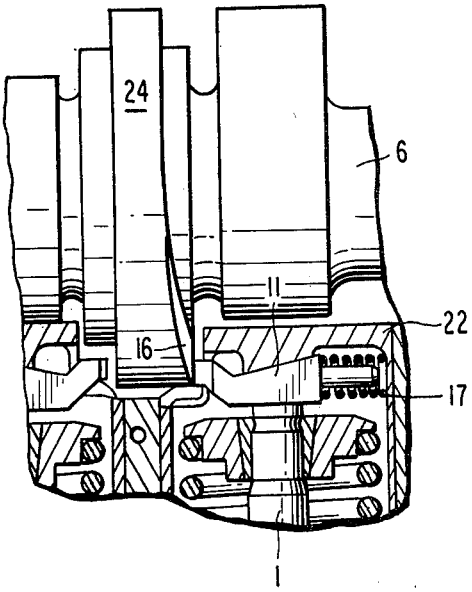
FIG. 5 is a partial cross sectional view of a further embodiment of a valve clearance compensator in accordance with the present invention within a cup tappet cooperating with the valve.

FIG. 5 provides an example of a valve clearance compensator wherein the axially acting cam 16 is also utilized as the adjusting member 13 with the cam 16 operating the sliding member 11 and displacing the same in a direction against the force or bias of the compression spring 17. One end of the compression spring 17 rests against an inner wall of the cup tappet 22.

The valve clearance compensators of the present invention operate in the following manner.

The sliding member 11, is axially displaceable between the control cam and the valve 1. Due to the wedge-shaped surface 10, the sliding member 11 is close to being of a self-locking nature. The displacement of the sliding member 11, effects in conjunction with the spring clearance 17, a clearance-free connection between the control cam 5 and the valve 1 during an opening time of the valve 1. By means of the adjusting member 13 operated by a camshaft, the sliding member 11 is axially displaced against the force of the compression spring 17 during a closing position phase of the valve 1 over a partial range of the closing time, wherein the valve operating parts are relieved of forces so that the clearance is produced between the control cam 5 and the valve 1. Thereafter, in good time prior to an opening of the valve 1, the adjusting member 13 again vacates the path of displacement for the sliding member 11 and the compression spring 17 urges the sliding member 11 into a position which eliminates the clearance between the control cam 5 and the valve 1. At the latest, upon an opening of the valve 1, there is then once more a clearance-free connection between the control cam 5 and the valve 1.

While I have shown and described only one embodiment in accordance with the present invention, it is understood that the same is not limited thereto but is susceptible of numerous changes and modifications known to one having ordinary skill in the art, and I therefore do not wish to be limited to the details shown and described herein but intend to cover all such changes and modifications as are encompassed by the scope of the appended claims.

I claim:

1. A clearance compensator for respective valves of an internal combustion engine which includes a camshaft having a plurality of operating control cam means for operating the valves of the engine, each compensator including a sliding member provided with a wedge-shaped surface, said sliding member being arranged so as to be axially displaceable between each control cam means and an associated valve, a compression spring means for constantly urging the sliding member in a first direction, and an adjusting means intermittently acting upon the sliding member so as to urge the sliding member in a direction opposite said first direction, characterized in that the adjusting means is connected with the camshaft and is adapted to displace the sliding member against a force of the compression spring means when the associated valve is in a closed position and over a partial range of a closed period of the valve, the adjusting means includes a disk adapted to be fixedly connected to the camshaft, said disk is provided with at least one cam means for axially displacing the sliding member, and a cup tappet is provided for each of the valves, and in that the sliding member is latitudinally movably guided in the respective cup tappets.

2. A clearance compensator according to claim 1, characterized in that the compression spring means are guided within the respective cup tappets.

3. A clearance compensator for respective valves of an internal combustion engine which includes a camshaft having a plurality of operating control cam means for operating the valves of the engine, each compensator including a sliding member provided with a wedge-shaped surface, said sliding member being arranged so as to be axially displaceable between each control cam means and an associated valve, a compression spring means for constantly urging the sliding member in a first direction, and an adjusting means intermittently acting upon the sliding member so as to urge the sliding member in a direction opposite said first direction, characterized in that the adjusting means is connected with the camshaft and is adapted to displace the sliding member against a force of the compression spring means when the associated valve is in a closed position and over a partial range of a closed period of the valve, characterized in that the adjusting means includes a disk adapted to be fixedly connected to the camshaft, said disk is provided with at least one cam means for axially displacing the sliding member.

4. A clearance compensator according to claim 3, wherein a cup tappet is provided for each of the valves, and in that the sliding member is latitudinally movably guided in the respective cup tappets, and means for spring biasing the sliding member with respect to a tappet part.

5. A clearance compensator according to claim 3, characterized in that a rocker arm means is interposed between the respective operating cam means and associated valves of the engine, characterized in that the sliding member is displaceable guided in the respective rocker arm means.

6. A clearance compensator according to claim 5, characterized in that a housing means laterally projects from each rocker arm means, and in that the compression spring means which constantly acts on the sliding member is accommodated in the housing means.

7. A clearance compensator according to claim 3, characterized in that a cup tappet is provided for each of the valves, and is that the sliding member is latitudinally movably guided in the respective cup tappets.

8. A clearance compensator according to claim 7 characterized in that the engine includes a cylinder head having a recess associated with each valve, characterized in that an axially displaceable piston is arranged in each of the recesses, and in that the axially displaceable piston cooperates with the sliding member and accommodates the compression spring means.

9. A clearance compensator according to claim 7, characterized in that the compression spring means are guided within the respective cup tappets.

10. A clearance compensator according to claim 3, characterized in that the adjusting means includes a rotatably supported multi-arm tilting lever having a first arm supported on a control cam means of the camshaft and a second lever arm adapted to contact an associated sliding member.

11. A clearance compensator according to claim 10, wherein the engine includes a cylinder head having a recess associated with each valve, characterized in that an axially displaceable piston is arranged in each of the recesses, and in that the axially displaceable piston cooperates with the sliding member and accommodates the respective compression spring means.

12. A clearance compensator according to one of claims 10 or 11, characterized in that a cup tappet is provided for each of the valves, and in that the sliding member is longitudinally movably guided in the respective cup tappets.

* * * * *